US009598923B2

(12) United States Patent
Gilleylen et al.

(10) Patent No.: US 9,598,923 B2
(45) Date of Patent: Mar. 21, 2017

(54) DOWNHOLE PULSE GENERATING DEVICE FOR THROUGH-BORE OPERATIONS

(71) Applicant: National Oilwell Varco, L.P., Houston, TX (US)

(72) Inventors: Russell Gilleylen, Spring, TX (US); Haresh Ghansyam, Pearland, TX (US); James R. Streater, Jr., Houston, TX (US); Deepthi Setlur, Houston, TX (US); Alan H. Kitching, Katy, TX (US); Shiran Waas, Houston, TX (US); Murray Gilbertson, Camps Bay (ZA)

(73) Assignee: National Oilwell Varco, L.P., Houston, TX (US)

( * ) Notice: Subject to any disclaimer, the term of this patent is extended or adjusted under 35 U.S.C. 154(b) by 411 days.

(21) Appl. No.: 14/090,829

(22) Filed: Nov. 26, 2013

(65) Prior Publication Data

US 2014/0151068 A1 Jun. 5, 2014

Related U.S. Application Data

(60) Provisional application No. 61/732,049, filed on Nov. 30, 2012.

(51) Int. Cl.

| | |
|---|---|
| ***E21B 4/02*** | (2006.01) |
| ***E21B 7/24*** | (2006.01) |
| ***E21B 28/00*** | (2006.01) |
| ***E21B 31/00*** | (2006.01) |

(52) U.S. Cl.

CPC ..... *E21B 28/00* (2013.01); *E21B 31/005* (2013.01)

(58) Field of Classification Search

CPC ..... E21B 28/00; E21B 31/00; E21B 34/063; E21B 4/02; E21B 7/24; E21B 4/003; F04C 13/008; F04C 2240/603

See application file for complete search history.

(56) References Cited

U.S. PATENT DOCUMENTS

| | | | | |
|---|---|---|---|---|
| 2,743,083 A | | 4/1956 | Zublin | |
| 2,865,602 A | * | 12/1958 | Whittle | E21B 4/02 175/107 |
| 4,058,163 A | | 11/1977 | Yandell | |
| 4,265,323 A | * | 5/1981 | Juergens | F04C 2/1073 175/107 |

(Continued)

FOREIGN PATENT DOCUMENTS

| | | |
|---|---|---|
| CA | 2680895 | 3/2011 |
| CN | 102418479 A | 4/2012 |

(Continued)

OTHER PUBLICATIONS

Search Report and Written Opinion dated Feb. 25, 2014 for International Application No. PCT/US2013/071997 (10 pgs.).

(Continued)

*Primary Examiner* — Kipp Wallace

(74) *Attorney, Agent, or Firm* — Derek V. Forinash; Porter Hedges LLP

(57) ABSTRACT

A downhole tool comprises a housing having a longitudinal bore and an agitator assembly disposed within the longitudinal bore of the housing. A removable component is disposed within the longitudinal bore and can be removed from the housing so as to at least partially open the longitudinal bore.

22 Claims, 5 Drawing Sheets

(56) References Cited

U.S. PATENT DOCUMENTS

| | | | | |
|---|---|---|---|---|
| 4,819,745 | A | 4/1989 | Walter | |
| 5,871,051 | A | 2/1999 | Mann | |
| 5,954,483 | A | 9/1999 | Tetzlaff | |
| 6,089,832 | A | 7/2000 | Patterson | |
| 6,279,670 | B1 | 8/2001 | Eddison et al. | |
| 6,289,998 | B1 | 9/2001 | Krueger et al. | |
| 6,419,014 | B1 * | 7/2002 | Meek | E21B 4/006 166/255.2 |
| 6,439,318 | B1 | 8/2002 | Eddison et al. | |
| 6,729,391 | B2 | 5/2004 | Hill et al. | |
| 7,139,219 | B2 | 11/2006 | Kolle et al. | |
| 7,201,222 | B2 | 4/2007 | Kanady et al. | |
| 7,419,007 | B2 | 9/2008 | Belcher et al. | |
| 8,167,051 | B2 | 5/2012 | Eddison et al. | |
| 8,181,719 | B2 | 5/2012 | Bunney et al. | |
| 2001/0054515 | A1 | 12/2001 | Eddison et al. | |
| 2004/0118611 | A1 * | 6/2004 | Runia | E21B 4/02 175/57 |
| 2005/0263289 | A1 * | 12/2005 | Kanady | F04C 13/008 166/369 |
| 2006/0060385 | A1 | 3/2006 | Amaudric et al. | |
| 2006/0243493 | A1 | 11/2006 | El-Rayes et al. | |
| 2007/0056771 | A1 | 3/2007 | Gopalan et al. | |
| 2007/0187112 | A1 | 8/2007 | Eddison et al. | |
| 2008/0029268 | A1 | 2/2008 | Macfarlane | |
| 2010/0038142 | A1 * | 2/2010 | Snyder | E21B 4/02 175/107 |
| 2010/0212900 | A1 | 8/2010 | Eddison et al. | |
| 2010/0326733 | A1 | 12/2010 | Anderson | |
| 2011/0000716 | A1 | 1/2011 | Comeau et al. | |
| 2011/0073374 | A1 | 3/2011 | Bunney et al. | |
| 2011/0094730 | A1 | 4/2011 | Johnson et al. | |
| 2012/0048619 | A1 | 3/2012 | Seutter et al. | |
| 2012/0127829 | A1 | 5/2012 | Sitka | |
| 2012/0279724 | A1 | 11/2012 | Eddison et al. | |

FOREIGN PATENT DOCUMENTS

| | | |
|---|---|---|
| EP | 1682746 | 10/2003 |
| WO | 2005042916 | 5/2005 |
| WO | 2008007066 | 1/2008 |
| WO | 2012138383 | 10/2012 |

OTHER PUBLICATIONS

Advertisment: drilformance.com: Accelglide 525-AG Specification Sheet: dated 2009 (1 pg.).

International Preliminary Report on Patentability dated Dec. 8, 2014 for corresponding International Application No. PCT/US2013/0071997 (15 pgs.).

Australian Examination Report dated Jun. 2, 2015 for corresponding Australian Application No. 2013352352 (5 pgs.).

PCT Search Report and Written Opinion dated Dec. 4, 2015 for counterpart PCT Application No. PCT/US2014/051435; (10 pgs).

EPO Search Report dated Dec. 18, 2015 for counterpart EPO Application No. 13859402.3; (4 pgs.).

Office Action issued Feb. 2, 2016 in corresponding Chinese Application No. 201380061685.4, (5 pgs).

* cited by examiner

DOWNHOLE PULSE GENERATING DEVICE FOR THROUGH-BORE OPERATIONS

CROSS-REFERENCE TO RELATED APPLICATIONS

This application claims priority to U.S. Patent Application Ser. No. 61/732,049, titled Downhole Pulse Generating Device for Through-Bore Operations, which was filed Nov. 30, 2012. This priority application is hereby incorporated by reference in its entirety into the present application, to the extent that it is not inconsistent with the present application.

BACKGROUND

This disclosure relates generally to methods and apparatus for generating vibrations or fluid pulses with a downhole tool. More specifically, this disclosure relates to methods and apparatus that enable components of a downhole pulse generating device to be retrieved from the drill string or otherwise facilitate fishing and other through-bore activities.

Downhole pulse generating devices are used to create fluctuations in fluid pressure that create vibrations in the drill string. The vibrations or pulses can help prevent the build-up of solid materials around the drill string, which can reduce friction and prevent the drill string from becoming stuck in the well. Thus, the use of pulse generating devices can be useful in extending the operating range of drilling assemblies.

Conventional pulse generating devices do not allow for fishing or other through bore operations to be performed below the device. Further, pulse generating devices can be difficult to remove from the wellbore without removing substantial portions of the drill string. In many cases, the pulse-generating device must be completely removed from the wellbore to in order to facilitate any fishing or other through-bore activities below the device.

Thus, there is a continuing need in the art for methods and apparatus for facilitating fishing or other through-bore activities below downhole pulse generation devices that overcome these and other limitations of the prior art.

BRIEF SUMMARY OF THE DISCLOSURE

A downhole tool comprises a housing having a longitudinal bore and an agitator assembly disposed within the longitudinal bore of the housing. A removable component is disposed within the longitudinal bore and can be removed from the housing so as to at least partially open the longitudinal bore. In certain embodiments, a through bore operation can be performed through the longitudinal bore once the removable component is removed from the housing. In certain embodiments, the removable component is a part of the agitator assembly. In certain embodiments, the agitator assembly further comprises a stator coupled to the housing and a rotor that is rotated by a fluid moving through the housing. In certain embodiments, the removable component is disposed within the rotor. In certain embodiments, the rotor is the removable component. In certain embodiments, the removable component is disposed within a bypass channel through the housing.

In other embodiments, a downhole tool comprises a housing having a longitudinal bore and an agitator assembly disposed within the housing and obstructing the longitudinal bore. A removable component is disposed within the housing and can be removed from the housing to at least partially open the longitudinal bore. In certain embodiments, a through bore operation can be performed through the longitudinal bore once the removable component is removed from the housing. In certain embodiments, the removable component is a part of the agitator assembly. In certain embodiments, the agitator assembly further comprises a stator coupled to the housing and a rotor that is rotated by a fluid moving through the housing. In certain embodiments, the removable component is disposed within the rotor. In certain embodiments, the rotor is the removable component. In certain embodiments, the removable component is disposed within a bypass channel through the housing.

In other embodiments, a method comprises disposing an agitator assembly in a housing having a longitudinal bore therethrough and disposing the agitator assembly and housing into a wellbore. The agitator assembly is operated by moving a fluid through the housing. A removable component can be removed from the housing so as to at least partially open a longitudinal bore through the housing. Once the removable component is removed, a downhole tool is run into the wellbore and through the longitudinal bore of the housing. In certain embodiments, the removable component is a part of the agitator assembly. In certain embodiments, the agitator assembly comprises a stator coupled to the housing and a rotor that is rotated by the fluid moving through the housing. In certain embodiments, the removable component is disposed within the rotor. In certain embodiments, the rotor is the removable component. In certain embodiments, the removable component is disposed within a bypass channel through the housing.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
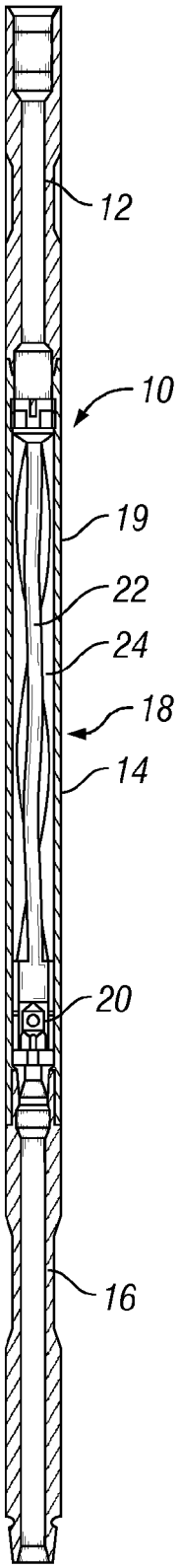
FIG. 1 is partial sectional view of an agitator assembly including a retrievable cartridge assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
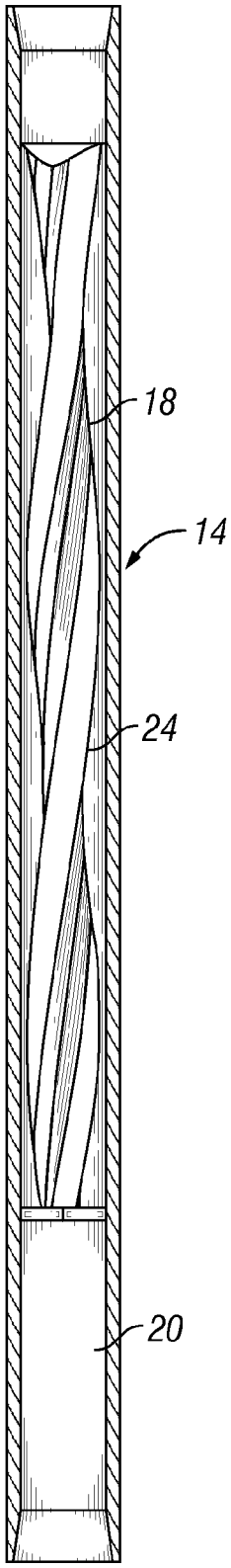
FIG. 2 is a partial sectional view of a retrievable cartridge assembly.

Referring initially to FIGS. 1 and 2, a downhole tool 10 includes an upper sub 12, an agitator assembly 14, and a lower sub 16. The agitator assembly 14 includes a power section 18 that is operatively coupled to a valve assembly 20 and disposed within an outer body 19. Power section 18 is illustrated as including a rotor 22 and a stator 24 forming a progressive cavity motor where fluid flow through the interface between the rotor and the stator causes the rotor to rotate. It is understood that in other embodiments, other motors, torque generators, actuators, and other devices can be used as a power section 18.

Valve assembly 20 is operatively coupled to the rotor 22 of power section 18. The valve assembly 20 is selectively opened to allow fluid to flow between the agitator assembly 14 and the lower sub 16. Selectively allowing fluid flow through valve assembly 20 generates fluctuations or pulses in the fluid pressure in the downhole tool 10, which creates vibrations in the downhole tool 10. The valve assembly 20 may be an axial flow valve, a radial flow valve, or any other valve configuration that can be operated by power section 18.

The agitator assembly 14, including the power section 18 and the valve assembly 20, forms a removable component that can be removed from the outer body 19 without disconnecting the outer body 19 from the upper sub 12 or the lower sub 16. The agitator assembly 14 can be coupled to the outer body 19 by a latch mechanism, shear connection, or any other releasable connection that allows the agitator assembly 14 to be decoupled from the outer body 19.

In certain embodiments, the agitator assembly 14 may include an engagement groove, latch profile, fishing neck, or other feature, that is coupled to the power section 18 and allows the power section 18 and the valve assembly 20 to be engaged by a fishing tool. Once engaged with the agitator assembly 14, the fishing tool can remove the power section 18 and coupled valve assembly 20 from the outer body 19. In certain embodiments, the process and tools used to remove the components from the agitator assembly 14 can also be used to re-install those components while the remainder of the agitator assembly remains in place.

In some embodiments, as an alternative to the agitator assembly 14, the valve assembly 20 can be coupled to the rotor 22 and sized such that the valve assembly 20 forms a removable component that can be removed from the downhole tool 10 through the stator 24. One end of the rotor 22 would be coupled to the valve assembly 20 while the other end of the rotor 22 would include an engagement groove, latch profile, fishing neck, or other feature that would enable a fishing tool to engage the rotor 22 and remove the rotor and coupled valve assembly 20 from the agitator assembly. Once the rotor 22 and valve assembly 20 are removed, the bore of the stator 24 is open and available to support though bore operations below the assembly.

Figure 3:
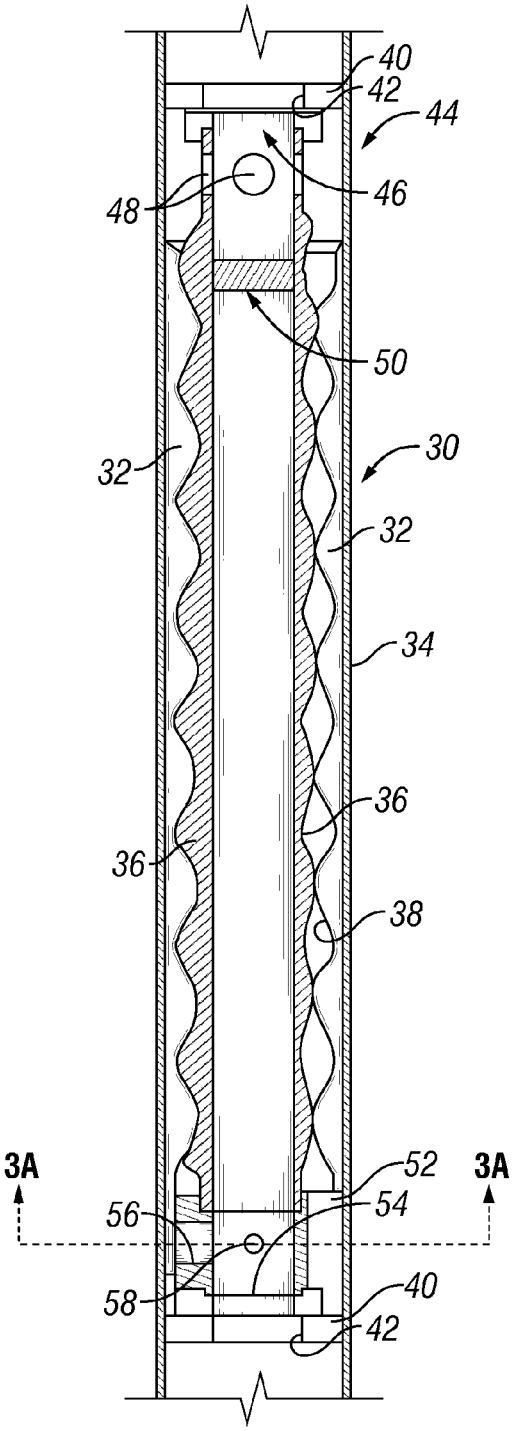
FIGS. 3 and 3A are partial sectional views of an agitator assembly with an integral rotor valve.
Figure 3A:
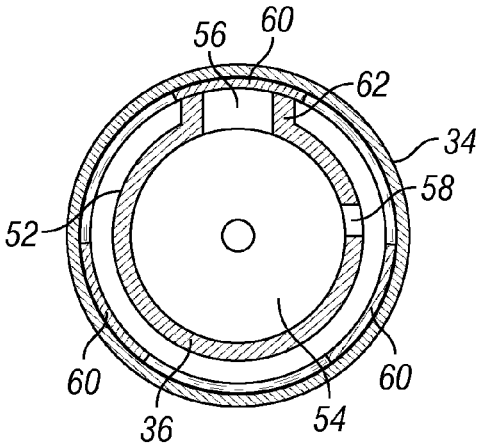

Referring now to FIGS. 3 and 3A, an agitator assembly 30 comprises a resilient stator 32 coupled to the inside surface of a housing 34. A rotor 36 is disposed within the housing 34 and has an outer surface that engages the inner surface 38 of the stator 32 to form a progressive cavity pump wherein the rotor 36 rotates in response to fluid being pumped in between the rotor and the stator. The rotor 36 is axially constrained within the housing 34 by stop members 40 that are disposed on either end of the rotor 36. The rotor 36 is illustrated as terminating at the stop members 40 but in other embodiments the rotor 36 may extend through one or both of the stop members 40. The stop members 40 are coupled to the housing 34 and prevent axial movement of the rotor 36 relative to the housing 34. The stop members 40 may be integrated into the housing 34 or disposed in an adjacent housing that is then coupled to housing 34. Each stop member 40 may include a flow port 42 that allows fluid to pass into and out of the rotor 36 or other flow ports that allow fluid to flow into the annulus between the rotor 36 and the housing 34.

Rotor 36 has an inlet end 44 having an axial inlet 46 that is substantially aligned with the flow port 42 through stop member 40. One or more radial outlets 48 provide a flow path that allows fluid to move from the interior of the rotor 36 into the interface between the rotor and the stator 32. In certain embodiments, a plug 50 prevents fluid from flowing through the interior of the rotor 36. In other embodiments, the rotor 36 can be constructed from a solid bar.

Rotor 36 also has an outlet end 52 including a fluid outlet 54 that is substantially aligned with the flow port 42 through stop member 40. The outlet end 52 may be integrally formed with rotor 36 or may be formed in a separate component that is coupled to the rotor 36. The outlet end 52 also includes a primary fluid inlet 56 and a secondary inlet 58 that allow fluid to flow into the outlet end 52 from the interface between the rotor 36 and the stator 32. One or more seal members 60 are coupled to the housing 34 and are configured to restrict the flow of fluid into the primary inlet 56 as the rotor 36 rotates relative to the housing. The number and configuration of fluid inlets 56, 58 and seal members 60 can be varied to control the number of pressure pulses generated per revolution of the rotor 36. For example, in certain embodiments, an outlet end 52 can include multiple fluid inlets 56 and/or seal members 60 in order to generate the desired frequency of pressure pulses. In certain embodiments, the fluid inlets 56, 58 may have a non-circular cross-section or may be selectively closed to further control the frequency of generated pressure pulses.

Each primary inlet 56 may be disposed within an eccentric projection 62 from the outlet end 52 of the rotor 36. The eccentric projections 62 may be integrally formed in the outlet end 52 or may be formed as a separate component and coupled to the outlet end 52. In certain embodiments, the eccentric projections 62 may also be heat treated and/or coated to reduce wear or fluid erosion. The primary inlet 56 will be substantially closed each time it contacts a seal member 60, which may be a portion of the stator 32 or may be a separate component coupled to the housing 34. Due to the rotation of rotor 36 and the configuration of the eccentric projection 62, the primary inlet 56 will contact each seal member 60 once per rotor revolution. As the rotor 36 rotates, the primary inlet 56 will move away from the seal member 60 to allow fluid to pass into the inlet and then back into contact with the seal member to restrict the flow of fluid through the inlet. In certain embodiments, the seal member 60 may extend around the entire inner surface of the housing 34.

In operation, fluid is supplied to the inlet end 44 of the rotor 36. The fluid flows through flow port 42 and the inlet 46 into the interior of the rotor 36. The fluid then flows through radial outlets 48 into the annulus between the rotor 36 and the housing 34. In certain embodiments, stop member 40 may include alternate flow paths that allow fluid to bypass the interior of the rotor 36 and flow directly into the annulus between the rotor 36 and housing 34. From the annulus, the fluid moves through the interface between the rotor 36 and the stator 32 and causes the rotor to rotate about its axis. Once the fluid reaches the outlet end 52 of the rotor 36, a portion of the fluid will pass into the interior of the rotor through the secondary inlet 58. The secondary inlet 58 is sized to allow sufficient fluid to pass so that rotor 36 will continue to rotate. Without a continuous flow of fluid, the rotor 36 will not rotate; therefore the secondary inlet 58 allows continuous flow of fluid through the assembly.

As the rotor 36 rotates, the primary inlet 56 is moved between a position aligned with a seal member 60 and a position not aligned with a seal member. When the primary inlet 56 is aligned with a seal member 60 fluid flow through the inlet is substantially restricted. When the primary inlet 56 is not aligned with a seal member 60, the fluid flow through the inlet is not restricted. Therefore, as the rotor 36 rotates, the intermittent engagement between the primary inlet 56 and the seal members 60 creates fluctuations or pressure pulses in the flow of fluid that generate vibrations in the system.

Agitator assembly 30 may be a removable component, as described with reference to FIGS. 1 and 2, or may enable fishing though the rotor 36. To enable fishing, or other through-bore activities, plug 50 may form a removable component that can be removed from the interior of the rotor 36, such as by fishing. Once the plug 50 has been removed, the flow ports 42 and the now unrestricted interior of the rotor 36 provide a bore through which fishing, or other through-bore operations, can be performed. Once those operations are complete, the plug 50 can be re-installed into the rotor 36 to allow the agitator assembly 30 to function. To facilitate removal, the plug 50 may be releasably coupled to the rotor 36 by a latching mechanism or feature, a threaded connection, a collet-type connection, or any other releasable connection.

In certain embodiments, plug 50 could be fitted with a nozzle, valve, or other flow control device to allow some of the flow to by-pass the rotor/stator geometry and flow directly through the interior of the rotor 36. This could be used to control the flow going through the agitator assembly 30 so as to limit the rotor speed and subsequent pressure pulse frequency. For example, the flow control device could be designed and incorporated such that as the flow and pressure increases, the more the pressure control device opens to allow more flow through the interior of the rotor 36. This increased flow can help maintain a relatively balanced and reasonably consistent flow through the rotor/stator geometry of the agitator 30.

Alternatively, plug 50 could be designed and incorporated so that a ball, dart, or other object could be 'dropped' into the drill string that would selectively block or open all or part of the fluid port in the plug 50 so as to increase or decrease the amount of flow going to the rotor/stator geometry. The size of the ball or other object could determine the amount of the fluid port in the plug that is blocked or opened.

In each of the embodiments described herein, the ability to adjust the flow going through the agitator assembly 30 can allow the frequency and the amplitude of the pressure pulses to be controlled. In certain embodiments, it may be desirable to be able to switch the agitator assembly 30 on and off so that pressure pulses are only generated when needed. For example, it may be desirable to stop the generation of pressure pulses so as to not interfere with measurement-while drilling (MWD) readings or other pressure-pulse based communication. In these embodiments, plug 50 could be designed and incorporated so that the flow to the rotor/stator geometry could normally be 'off' and when the plug is activated, such as by the dropping of a ball or by altering the flow of fluid, then fluid is allowed to flow to the agitator 30. For example, plug 50 could be designed such that the radial outlets 48 in the rotor could be blocked to prevent the flow going through the rotor/stator geometry of the agitator 30. Activation of the plug 50 would move the plug and open up the outlets 48 so the flow goes through the rotor/stator geometry and rotates the rotor. The plug 50 could be further activated by a reduction in flow and pressure, or by another means, so that the plug again blocks the outlets 48.

Figure 4:
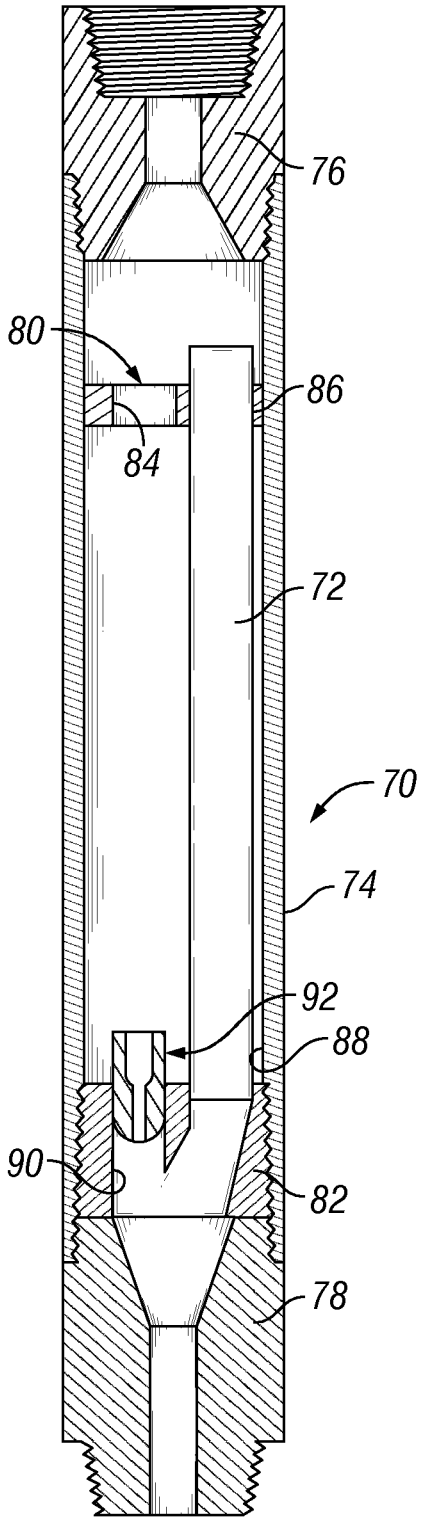
FIG. 4 is a partial sectional view of a retrievable agitator assembly disposed in an offset housing.

Referring now to FIG. 4, an agitator assembly 70 comprises an agitator 72 that is disposed in an offset position within a tool body 74. The ends of the tool body 74 are coupled to a top sub 76 and a bottom sub 78. An upper retainer 80 and a lower retainer 82 are disposed within and coupled to the tool body 74. The upper retainer 80 includes a flow port 84 and an upper agitator receptacle 86. The lower retainer 82 includes a lower agitator receptacle 88 that is substantially aligned with the upper agitator receptacle 86 and a bypass channel 90. In certain embodiments, a flow restrictor 92 may be releasably coupled to the bypass channel 90.

In operation, the offset position of the agitator 72 allows through-bore tools to be run through the agitator assembly 70 via the flow port 84 and bypass channel 90. A flow restrictor 92 may be installed to ensure sufficient flow is diverted to the agitator 72 so that the agitator can generate the desired pressure pulses and vibrations. The flow restrictor 92 may be a removable component that can be selectively removed from the bypass channel 90 so that the full diameter of the bypass channel 90 is available. In this manner, through-bore operations can be undertaken without removing the agitator 72 from the agitator assembly 70.

Figure 5:
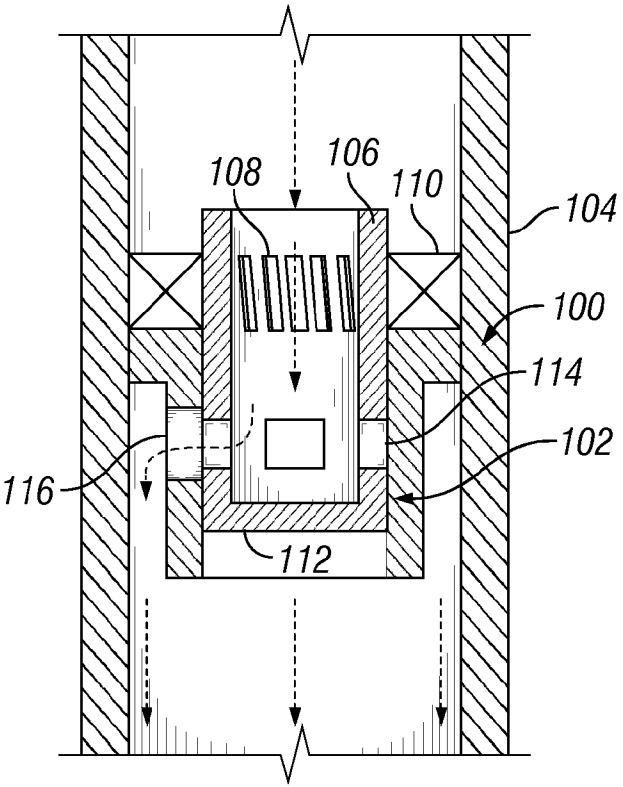
FIG. 5 is a partial sectional view of a retrievable agitator assembly comprising internal vanes.

Referring now to FIG. 5, an agitator assembly 100 includes an outer body 102 that forms a stator coupled to a housing 104. A rotatable inner body 106 forms a rotor that is disposed at least partially within the outer body 102 and includes internal vanes 108, or other features, that cause the inner body 106 to rotate when fluid flows axially through the assembly. In certain embodiments, the inner body 106 may be supported on bearings 110.

The inner body 106 has a substantially solid lower end 112 so that fluid is diverted axially through one or more outlets 114. As the inner body 106 rotates, the outlets 114 periodically align with one or more flow ports 116 through the outer body 102. When the outlets 114 are aligned with the flow ports 116, fluid can flow through the assembly 100. When the outlets 114 are not aligned with the flow ports 116, fluid flow is restricted and fluid pressure will increase. Therefore, the rotation of the inner body 106 creates pressure pulses and vibrations in the assembly 100.

In order to facilitate through-bore operations, the inner body 106 can form a removable component be removed from the outer body 102 and assembly 100. In certain embodiments, the inner body 106 may also have one or more features that allow a tool to engage the inner body and remove it from the assembly 100. These features can include engagement grooves, latch profiles, fishing necks, or any other feature that allow the inner body 106 to be engaged by a retrieval tool. Once the inner body 106 is removed, the full bore of the outer body 102 is unrestricted.

Figure 6:
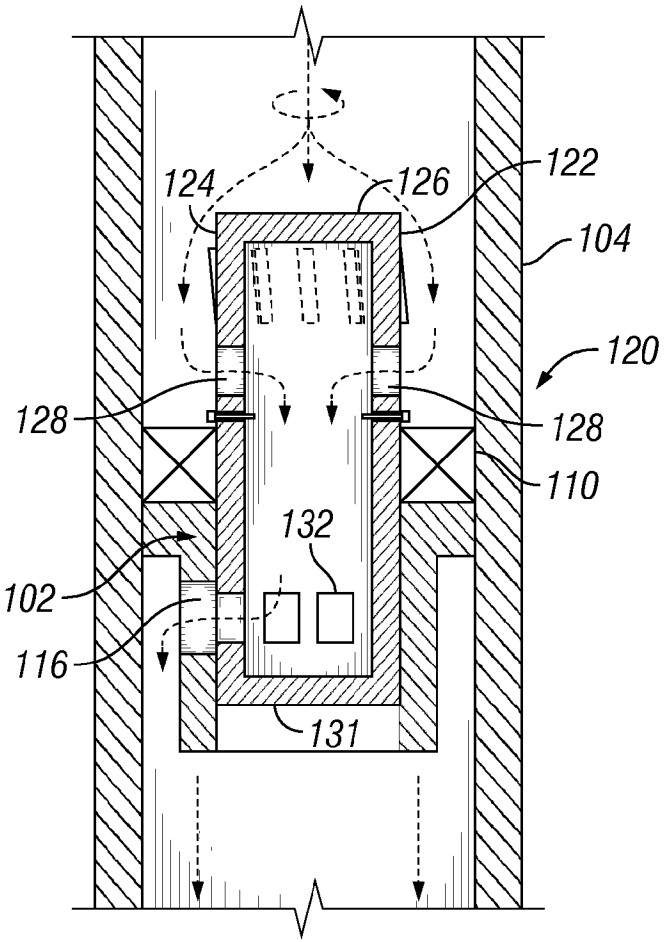
FIG. 6 is a partial sectional view of a retrievable agitator assembly comprising external vanes and a radial flow valve.

FIG. 6 illustrates a similar agitator assembly 120 having an outer body 102 that forms a stator coupled to a housing 104. A rotatable inner body 122 forms a rotor that is disposed at least partially within the outer body 102 and includes external vanes 124, or other features, that cause the inner body 122 to rotate when fluid flows axially through the assembly. In certain embodiments, the inner body 122 may be supported on bearings 110. The inner body 122 has a solid upper end 126 that diverts fluid into the annulus between the inner body 122 and the housing 104. As the fluid moves through the annulus is crosses the vanes 124 and re-enters the inner body 122 through inlet ports 128.

The inner body 122 also has a substantially solid lower end 131 that diverts fluid axially through one or more outlets 132. As the inner body 122 rotates, the outlets 132 periodically align with one or more flow ports 116 through the outer body 102. When the outlets 132 are aligned with the flow ports 116, fluid can flow through the assembly 120. When the outlets 132 are not aligned with the flow ports 116, fluid flow is restricted and fluid pressure will increase. Therefore, the rotation of the inner body 122 creates pressure pulses and vibrations in the assembly 120.

In order to facilitate through-bore operations, the inner body 122 forms a removable component that can be removed from the outer body 102 and assembly 120. In certain embodiments, the inner body 122 may also have one or more features that allow a tool to engage the inner body 122 and remove it from the assembly 120. These features can include engagement grooves, latch profiles, fishing necks, or any other feature that allow the inner body 122 to be engaged by a retrieval tool. Once the inner body 122 is removed, the full bore of the outer body 102 is unrestricted.

Figure 7:
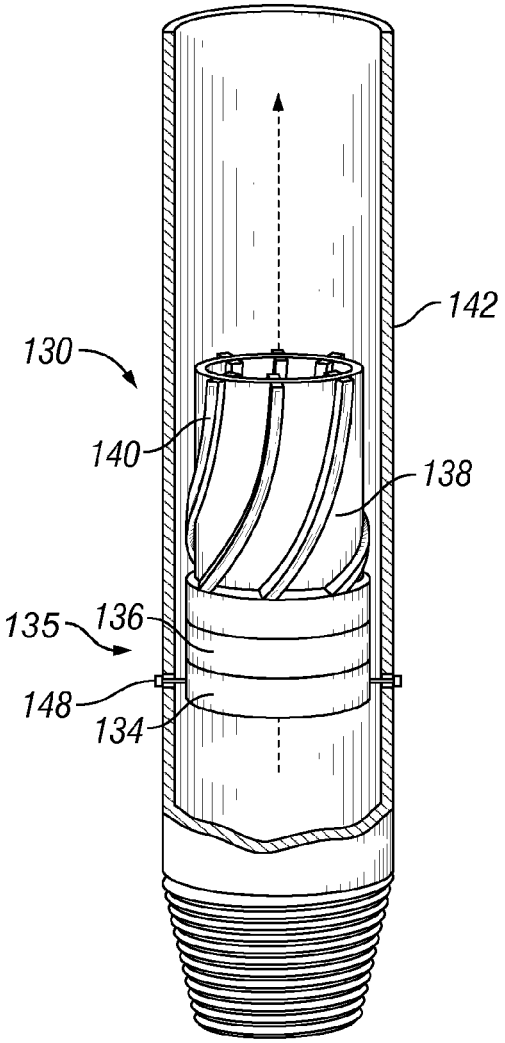
FIG. 7, 7A, and 7B are partial sectional views of a retrievable agitator assembly comprising external vanes and an axial flow valve.
Figure 7A:
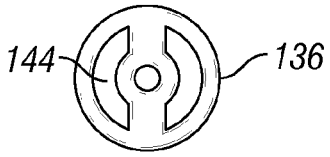
Figure 7B:
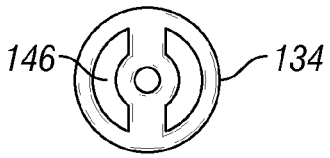

FIGS. 7, 7A, and 7B illustrate an agitator assembly 130 that incorporates an axial flow valve 135 formed by a stationary flow plate 134 and a rotating flow plate 136. The agitator assembly 130 includes rotor formed by a rotatable body 138 that includes vanes 140 and the rotating flow plate 136. The rotatable body 138 is rotatably coupled to a stator formed by the stationary flow plate 134, which is coupled to a housing 142.

As fluid flow through the housing 142 it flows over vanes 140 and rotates the body 138 and flow plate 136. The flow plate 136 includes flow ports 144 that periodically align with flow ports 146 in the stationary flow plate 134 as it is rotated. When the flow ports 144 are aligned with the flow ports 146, fluid can flow through the assembly 130. When the flow ports 144 are not aligned with the flow ports 146, fluid flow is restricted and fluid pressure will increase. Therefore, the rotation of the body 138 creates pressure pulses and vibrations in the assembly 130.

In order to facilitate through-bore operations, the agitator assembly 130 may be a removable component that can be removed from the housing 142. To facilitate removal, the assembly 130 may be releasably coupled to the housing 142 by a latching mechanism, a threaded connection, shear connection, a collet-type connection, or any other releasable connection. In certain embodiments, the assembly 130 may also have one or more features 148 that allow a tool to engage the assembly 130 and remove it from the housing 142. These features can include engagement grooves, latch profiles, fishing necks, or any other feature that allow the assembly 130 to be engaged by a retrieval tool. Once the assembly 130 is removed, the full bore of the housing 142 is unrestricted.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A downhole tool connectable to a drill string, the drill string for conveying drilling fluid through its interior, the downhole tool comprising:

a housing having a longitudinal bore;

an agitator assembly disposed within the longitudinal bore of the housing, wherein the agitator assembly includes a power section having a rotor coupled to a valve assembly, wherein the valve assembly is selectively opened by rotation of the rotor so as to allow drilling fluid flow from the interior of the drill string at one end of the housing, through the agitator assembly to the interior of the drill string at the other end of the housing, whereby pressure pulses are generated in the drilling fluid contained within the interior of the drill string and vibrations are created in the drill string; and a removable component disposed within and obstructing the longitudinal bore, wherein the removable component can be removed to at least partially open the longitudinal bore, wherein a through bore operation can be performed through the longitudinal bore once the removable component is removed.

2. The downhole tool of claim 1, wherein the removable component is a part of the agitator assembly.

3. The downhole tool of claim 1, wherein the agitator assembly further comprises a stator coupled to the housing and wherein the rotor is rotated by a fluid moving through the housing.

4. The downhole tool of claim 3, wherein the removable component is disposed within the rotor.

5. The downhole tool of claim 3, wherein the rotor is the removable component.

6. The downhole tool of claim 1, wherein the removable component is disposed within a bypass channel through the housing.

7. The downhole tool of claim 1, wherein the agitator assembly further comprises an annulus formed between the rotor and the housing and the valve assembly includes a fluid inlet that provides selective fluid flow from the annulus into the rotor.

8. The downhole tool of claim 7, wherein the fluid inlet is disposed on an eccentric projection and the housing has a seal member that restricts a flow of fluid through the inlet as the rotor rotates.

9. The downhole tool of claim 1, further comprising a stop member that axially constrains the rotor relative to the housing, wherein the stop member includes a flow port providing fluid communication between the housing and the agitator assembly.

10. The downhole tool of claim 1, wherein the power section also includes a stator and the stator is coupled to the housing.

11. A downhole tool connectable to a drill string, the drill string for conveying drilling fluid through its interior, the downhole tool comprising:

a housing having a longitudinal bore;

an agitator assembly disposed within the housing and obstructing the longitudinal bore, wherein the agitator assembly includes a power section having a rotor, a valve assembly coupled to the rotor, an annulus formed between the rotor and the housing, and a fluid inlet that provides selective fluid flow from the annulus into the valve assembly rotor: and a removable component disposed within the housing, wherein the removable component can be removed to at least partially open the longitudinal bore: and stop members disposed on either end of the rotor that axially constrain the rotor relative to the housing, wherein the valve assembly is selectively opened in unison with the rotation of the rotor so as to allow drilling fluid flow from the interior of the drill string at one end of the housing, through the agitator assembly to the interior of the drill string at the other end of the housing whereby pressure pulses are generated in the drilling fluid contained within the interior of the drill string and vibrations are created in the drill string, wherein a through bore operation can be performed through the longitudinal bore once the removable component is removed.

12. The downhole tool of claim 11, wherein the removable component is a part of the agitator assembly.

13. The downhole tool of claim 11, wherein the agitator assembly further comprises a stator coupled to the housing and wherein the rotor is rotated by a fluid moving through the housing.

14. The downhole tool of claim 13, wherein the removable component is disposed within the rotor.

15. The downhole tool of claim 11, wherein the removable component is disposed within a bypass channel through the housing.

16. A method comprising:

disposing an agitator assembly in a housing having a longitudinal bore therethrough, wherein the agitator assembly includes a power section having a rotor coupled to a valve assembly;

connecting the housing to connectable to a drill string, the drill string for conveying drilling fluid through its interior;

disposing the agitator assembly and housing into a wellbore;

operating the agitator assembly by moving drilling fluid from the interior of the drill string at one end of the housing, through the agitator assembly to the interior of the drill string at the other end of the housing;

selectively opening the valve assembly by rotation of the rotor to allow fluid flow through the agitator assembly, whereby pressure pulses are generated in the drilling fluid contained within the interior of the drill string and vibrations are created in the drill string;

removing a removable component to at least partially open a longitudinal bore through the housing; and performing a through bore operation including running a downhole tool into the wellbore and through the longitudinal bore of the housing once the removable component is removed.

17. The method of claim 16, wherein the removable component is a part of the agitator assembly.

18. The method of claim 16, wherein the agitator assembly comprises a stator coupled to the housing and wherein the rotor is rotated by the fluid moving through the housing.

19. The method of claim 18, wherein the removable component is disposed within the rotor.

20. The method of claim 18, wherein the rotor is the removable component.

21. The method of claim 18, wherein the removable component is disposed within a bypass channel through the housing.

22. The methods of claim 16, wherein the rotor has an inlet disposed on an eccentric projection and the housing has a seal member, the method further comprising:

restricting a flow of fluid through the inlet as the rotor rotates.

* * * * *